US011571594B2

(12) United States Patent
Furson

(10) Patent No.: US 11,571,594 B2
(45) Date of Patent: Feb. 7, 2023

(54) FIRE EXTINGUISHING RANGE ASSEMBLY

(71) Applicant: Raheem Furson, Philadelphia, PA (US)

(72) Inventor: Raheem Furson, Philadelphia, PA (US)

( * ) Notice: Subject to any disclaimer, the term of this patent is extended or adjusted under 35 U.S.C. 154(b) by 115 days.

(21) Appl. No.: 17/173,814

(22) Filed: Feb. 11, 2021

(65) Prior Publication Data

US 2022/0249890 A1 Aug. 11, 2022

(51) Int. Cl.
*A62C 3/00* (2006.01)
*A62C 37/40* (2006.01)

(52) U.S. Cl.
CPC ..... *A62C 3/006* (2013.01); *A62C 37/40* (2013.01)

(58) Field of Classification Search
CPC ..... A62C 3/006; A62C 37/40
See application file for complete search history.

(56) References Cited

U.S. PATENT DOCUMENTS 3,653,443 A * 4/1972 Dockery ..... F24C 15/2021 169/65
4,830,116 A * 5/1989 Walden ..... A62C 2/04 169/17
4,834,188 A * 5/1989 Silverman ..... A62C 3/04 169/59
D308,947 S 7/1990 Downing
4,979,572 A * 12/1990 Mikulec ..... A62C 3/006 239/524
5,063,998 A * 11/1991 Quinn ..... A62C 2/04 169/59
5,127,479 A * 7/1992 Stehling ..... A62C 3/006 285/31
5,297,636 A * 3/1994 North ..... A62C 3/006 169/65
5,697,450 A * 12/1997 Stehling ..... A62C 3/006 367/199
5,871,057 A * 2/1999 Stehling ..... A62C 3/006 367/199
6,029,751 A * 2/2000 Ford ..... A62C 3/006 169/65
6,186,241 B1 * 2/2001 Murr ..... A62C 3/006 169/65
6,341,655 B1 * 1/2002 Busian ..... A62C 2/04 169/59
6,624,750 B1 9/2003 Marman
8,230,939 B1 * 7/2012 Reynolds ..... F24C 15/2021 169/56
8,651,014 B2 * 2/2014 Vidojevic ..... A62C 3/006 219/400

(Continued)

*Primary Examiner* — Joseph A Greenlund

(57) ABSTRACT

A fire extinguishing range assembly includes a range has an oven is integrated therein and a plurality of burners. An oven temperature sensor is integrated into the range and a burner temperature sensor is integrated into the range. A fire extinguisher is integrated into the range and the fire extinguisher contains a fire retardant. The fire extinguisher is actuated when either of the burner temperature sensor or the oven temperature sensor senses a temperature that exceeds a pre-determined temperature. A plurality of nozzles is strategically distributed around the range. Each of nozzles is in fluid communication with the fire extinguisher thereby facilitating each of the nozzles to spray the fire retardant when the fire extinguisher is actuated to extinguish a fire that is burning in or on the range.

6 Claims, 7 Drawing Sheets

(56) References Cited

U.S. PATENT DOCUMENTS

| | | | | |
|---|---|---|---|---|
| 8,757,281 | B1 * | 6/2014 | Saba | F24C 3/12 169/65 |
| 8,895,904 | B1 * | 11/2014 | Briones, Jr. | H05B 1/0261 219/494 |
| 9,183,731 | B1 | 11/2015 | Bokhary | |
| 9,539,450 | B2 * | 1/2017 | Rouse | A62C 3/006 |
| 9,846,413 | B2 | 12/2017 | Thorpe | |
| 10,555,383 | B1 | 2/2020 | Caccamo | |
| 2007/0240887 | A1 * | 10/2007 | Howeth | A62C 3/006 239/548 |
| 2009/0294141 | A1 * | 12/2009 | Rouse | A62C 3/006 169/65 |
| 2009/0321093 | A1 * | 12/2009 | Lalouz | A62C 37/12 169/65 |
| 2010/0000747 | A1 * | 1/2010 | Reynolds | F24C 15/2021 169/65 |
| 2013/0341053 | A1 * | 12/2013 | Rouse | A62C 35/605 169/23 |
| 2016/0096050 | A1 * | 4/2016 | Vermeersch | F24C 15/02 220/88.2 |
| 2017/0130967 | A1 * | 5/2017 | Weaver, Jr. | F24C 15/2007 |
| 2017/0144002 | A1 * | 5/2017 | Ben Neria | A62C 37/44 |
| 2017/0146247 | A1 * | 5/2017 | Lee | F24C 15/18 |
| 2017/0266473 | A1 * | 9/2017 | Bohrer | A62C 3/006 |
| 2020/0238112 | A1 * | 7/2020 | Kjellman | A62C 37/44 |
| 2020/0306570 | A1 * | 10/2020 | Kjellman | A62C 37/40 |
| 2021/0146174 | A1 * | 5/2021 | Howlett | A62C 35/02 |
| 2021/0220683 | A1 * | 7/2021 | Lines | A62C 35/13 |
| 2022/0237948 | A1 * | 7/2022 | Goulden | G06T 7/70 |
| 2022/0249890 | A1 * | 8/2022 | Furson | A62C 3/006 |

* cited by examiner

FIRE EXTINGUISHING RANGE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to fire extinguishing devices and more particularly pertains to a new fire extinguishing device for automatically extinguishing a fire in a range. The fire extinguishing device is integrated into a range that is used to cook food. Additionally, the fire extinguishing device includes wireless communication capabilities to facilitate a user to remotely monitor the range.

(2) Description of Related Art Including Information Disclosed Under 37 CFR 1.97 and 1.98

The prior art relates to fire extinguishing devices including a variety of fire shut off systems that automatically shuts off a range when a smoke detector near the range detects smoke. Additionally, the prior art discloses a wireless alert system that facilitates a user to remotely monitor an emergency situation. Additionally, the prior art discloses a smoke detecting microwave oven that shuts off when smoke is detected inside of the microwave oven. In no instance does the prior art disclose a range that has a fire extinguisher integrated therein for automatically extinguishing a fire in or on the range.

BRIEF SUMMARY OF THE INVENTION

An embodiment of the disclosure meets the needs presented above by generally comprising a range has an oven is integrated therein and a plurality of burners. An oven temperature sensor is integrated into the range and a burner temperature sensor is integrated into the range. A fire extinguisher is integrated into the range and the fire extinguisher contains a fire retardant. The fire extinguisher is actuated when either of the burner temperature sensor or the oven temperature sensor senses a temperature that exceeds a pre-determined temperature. A plurality of nozzles is strategically distributed around the range. Each of nozzles is in fluid communication with the fire extinguisher thereby facilitating each of the nozzles to spray the fire retardant when the fire extinguisher is actuated to extinguish a fire that is burning in or on the range.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
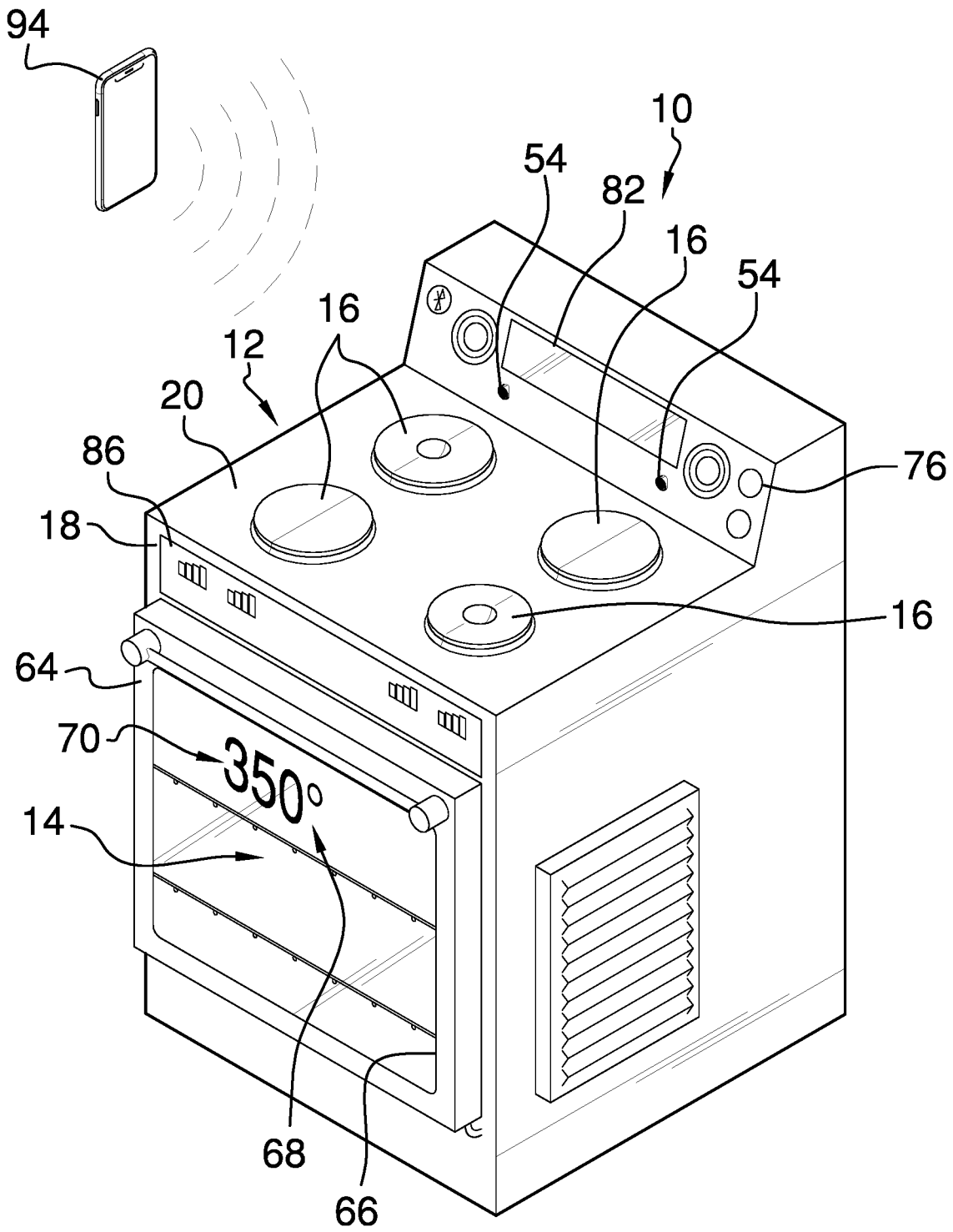
FIG. 1 is a top perspective view of a fire extinguishing range assembly according to an embodiment of the disclosure.
Figure 2:
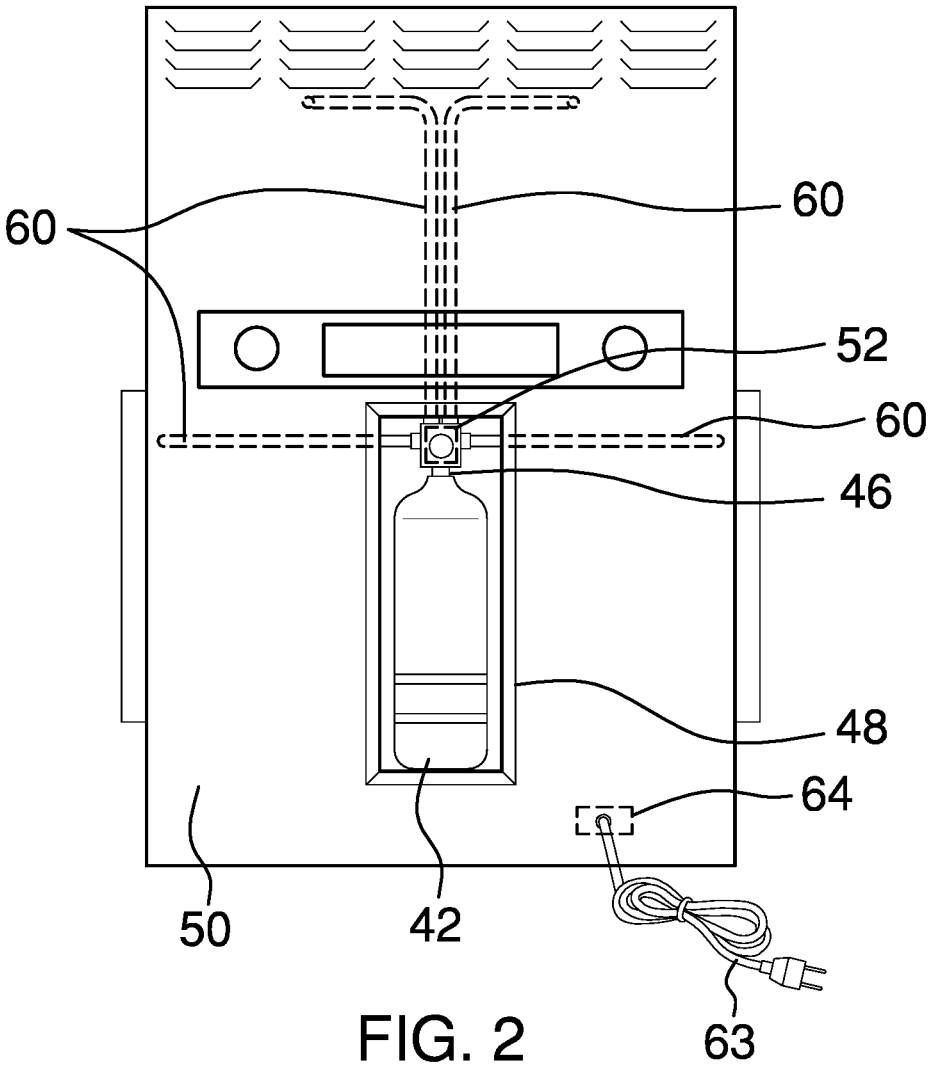
FIG. 2 is a back phantom view of an embodiment of the disclosure.
Figure 3:
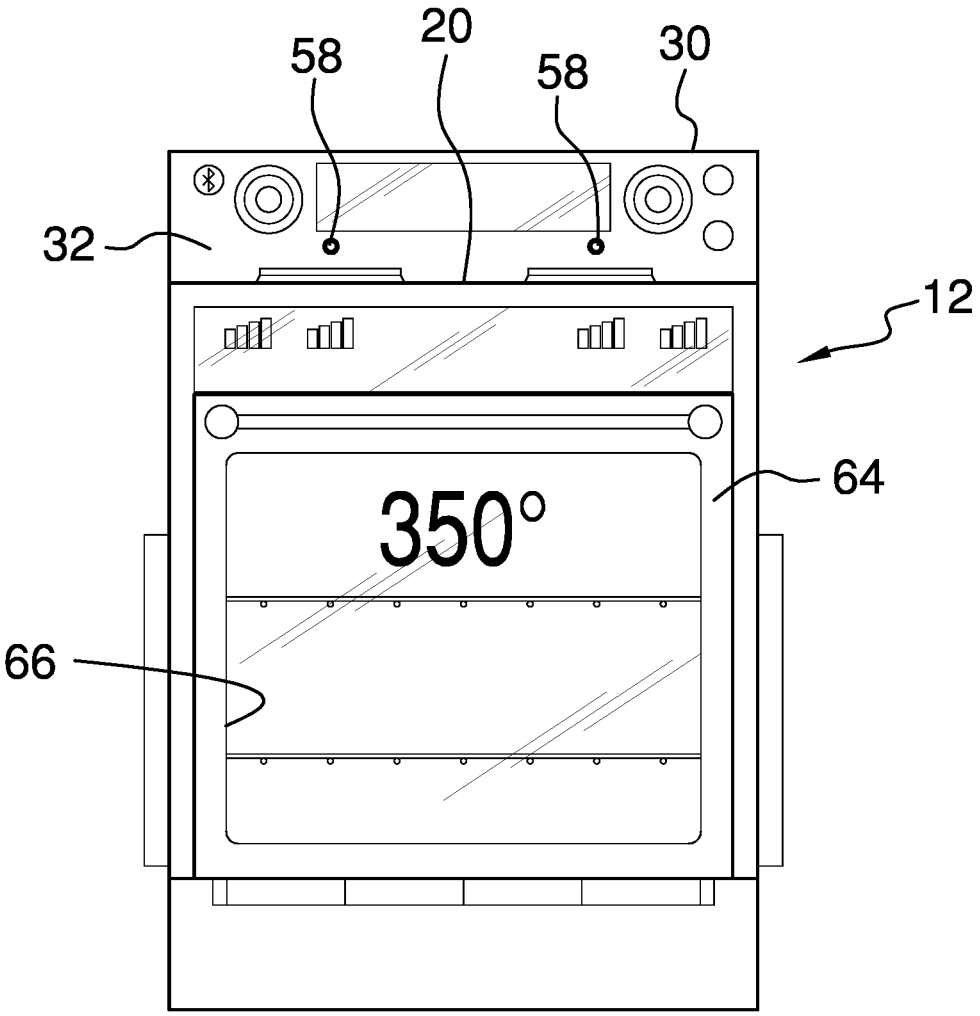
FIG. 3 is a front view of an embodiment of the disclosure.
Figure 4:
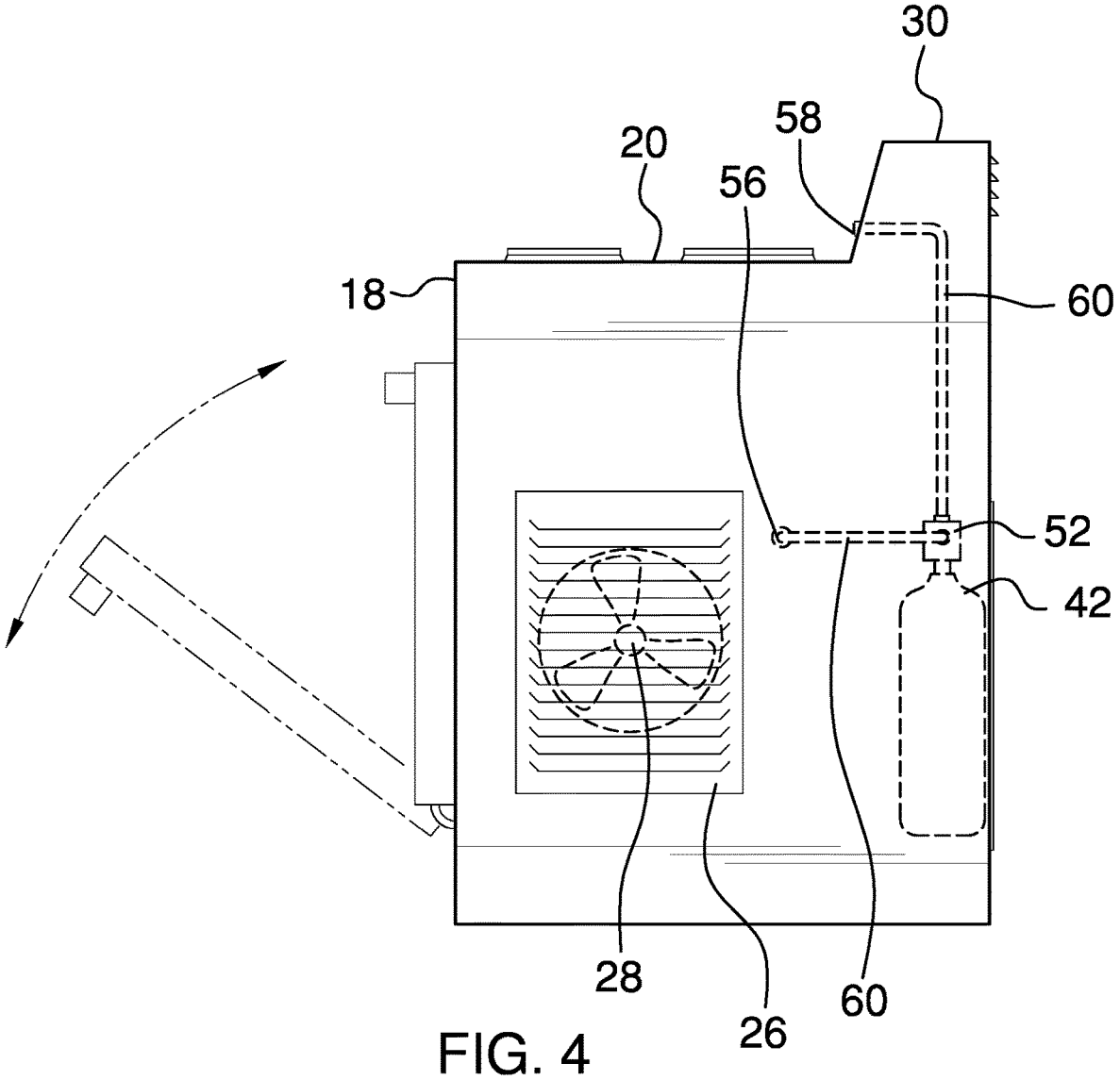
FIG. 4 is a left side phantom view of an embodiment of the disclosure.
Figure 5:
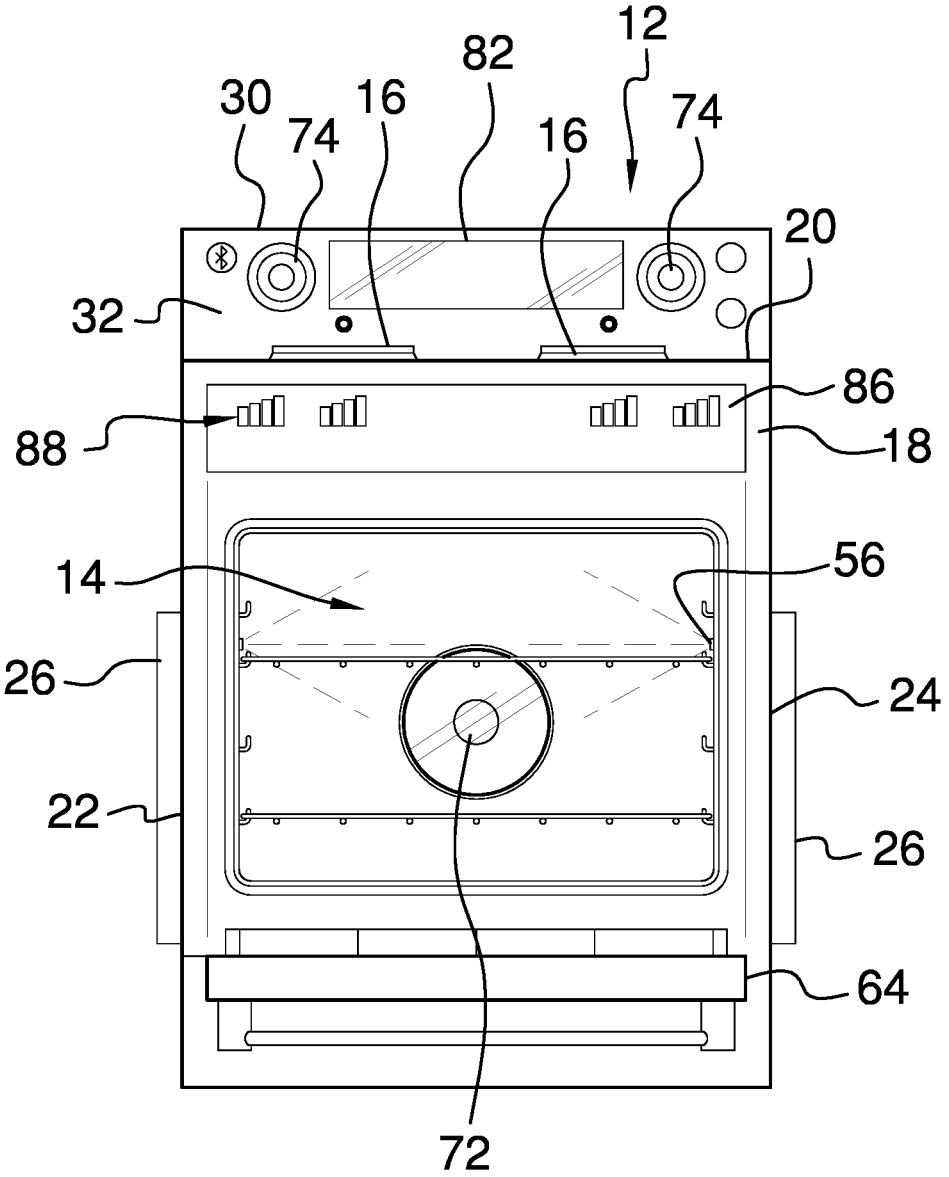
FIG. 5 is a front interior view of an embodiment of the disclosure.
Figure 6:
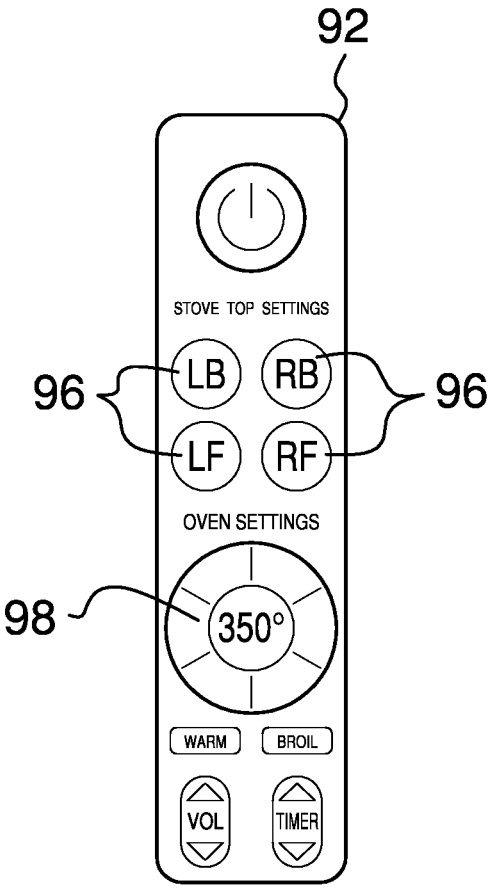
FIG. 6 is a perspective view of a remote control of an embodiment of the disclosure.
Figure 7:
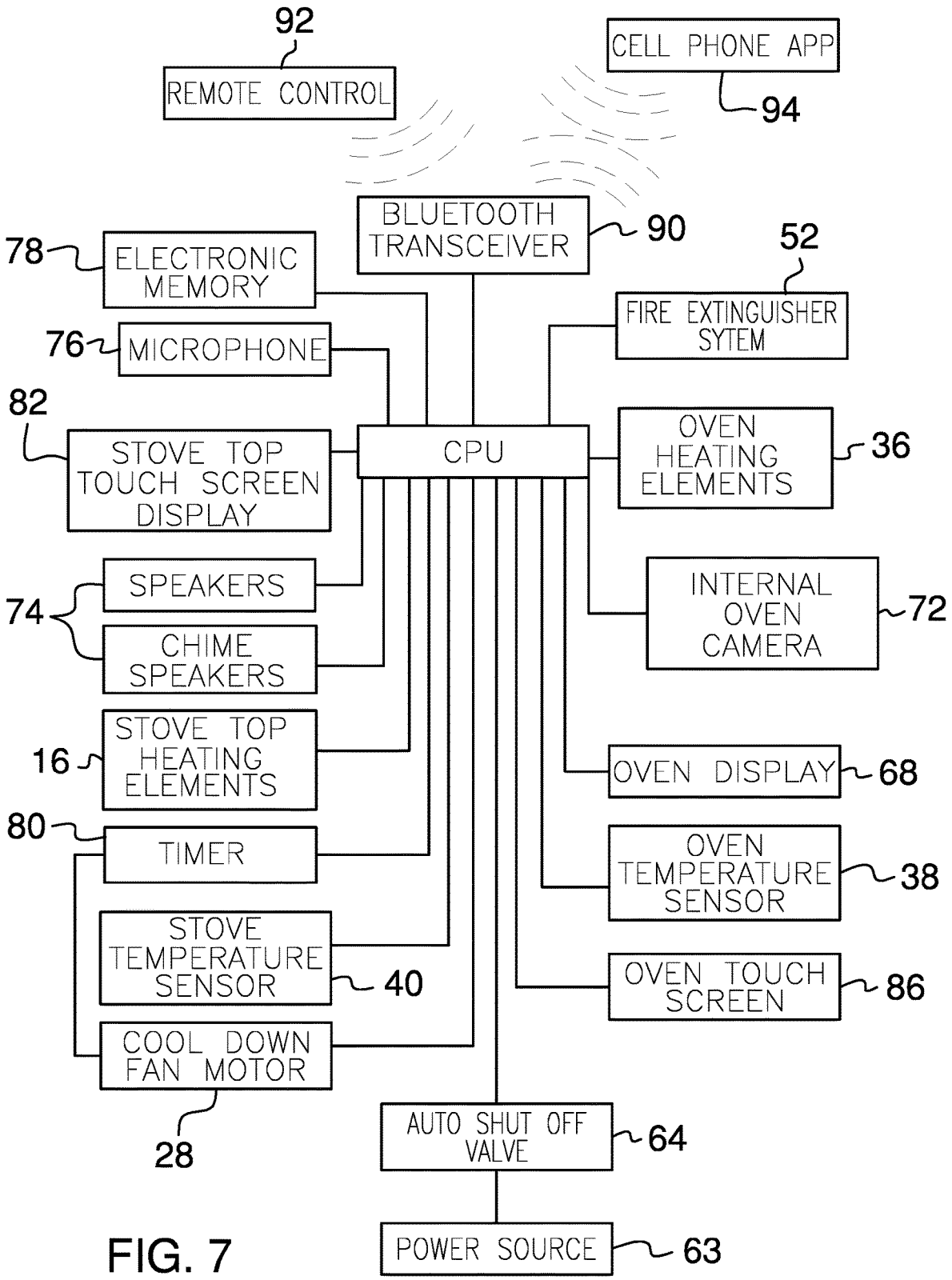
FIG. 7 is a schematic view of an embodiment of the disclosure.

With reference now to the drawings, and in particular to FIGS. 1 through 7 thereof, a new fire extinguishing device embodying the principles and concepts of an embodiment of the disclosure and generally designated by the reference numeral 10 will be described.

As best illustrated in FIGS. 1 through 7, the fire extinguishing range assembly 10 generally comprises a range 12 that has an oven 14 integrated therein and a plurality of burners 16 for cooking food items. The range 12 may comprise an electric stove, a gas stove or any other type of appliance that might be employed in a kitchen for cooking food. The range 12 has a front side 18, a top wall 20, a first lateral wall 22 and a second lateral wall 24. The front side 18 is open into an interior of the range 12 to define the oven 14 and each of the burners 16 is positioned on the top wall 20. The range 12 has a pair of vents 26 each extending through a respective one of the first lateral wall 22 and the second lateral wall 24 into the oven 14 to pass air therethrough. A pair of blowers 28 is each integrated into a respective one of the vents 26 and each of the blowers 28 urges air outwardly through the respective vent 26 when the blowers 28 are turned on for ventilating the oven 14. Each of the blowers 28 may include an electric motor and a fan that is rotatably coupled to the electric motor.

The range 12 has a control panel 30 extending upwardly from the top wall 20, and the control panel 30 has a forward face 32. The control panel 30 may include controls that are conventional to ranges or stoves, including but not being limited to, temperature controls for the burners 16 and oven 14. A control circuit 34 is integrated into the oven 14 and the control circuit 34 receives an extinguish input. The control circuit 34 is in communication with a heat source 36 in the oven 14 and the control circuit 34 is in communication with each of the burners 16. The control circuit 34 turns off the heat source 36 in the oven 14 and each of the burners 16 when the control circuit 34 receives the extinguish input. Additionally, each of the blowers 28 is electrically coupled to the control circuit 34 and each of the blowers 28 is turned on when the control circuit 34 receives the extinguish input.

An oven temperature sensor 38 is integrated into the range 12 and the oven temperature sensor 38 is positioned within the oven 14 such that the oven temperature sensor 38 is in thermal communication with an interior of the oven 14. The oven temperature sensor 38 is electrically coupled to the control circuit 34. Additionally, the control circuit 34 receives the extinguish input when the oven temperature sensor 38 senses a temperature that exceeds a pre-determined temperature. The oven temperature sensor 38 may comprise an electronic temperature sensor or the like and the pre-determined temperature may be a temperature that corresponds to an open flame burning in the oven 14.

A burner temperature sensor 40 is integrated into the range 12 and the burner temperature sensor 40 is positioned adjacent to the plurality of burners 16 such that the burner temperature sensor 40 is in thermal communication with the burners 16. The burner temperature sensor 40 is electrically coupled to the control circuit 34. Additionally, the control circuit 34 receives the extinguish input when the burner temperature sensor 40 senses a temperature that exceeds a pre-determined temperature. The burner temperature sensor 40 may comprise an electronic temperature sensor or the like and the pre-determined temperature may be a temperature that corresponds to an open flame burning on the top wall 20 of the range 12.

A fire extinguisher 42 is integrated into the range 12 and the fire extinguisher 42 contains a fire retardant 44. The fire extinguisher 42 has an outlet 46, and the fire extinguisher 42 may be positioned in a recess 48 that extends into a back wall 50 of the range 12. A valve 52 is fluidly coupled to the fire extinguisher 42 and the valve 52 is in fluid communication with the outlet 46. The valve 52 is actuatable into an open condition for releasing the fire retardant 44 from the fire extinguisher 42. Additionally, the valve 52 is in a normally closed condition for inhibiting the fire retardant 44 from escaping the fire extinguisher 42. The valve 52 is electrically coupled to the control circuit 34 and the valve 52 is actuated into the open condition when the control circuit 34 receives the extinguish input. The valve 52 may comprise an electrically operated gas valve or the like.

A plurality of nozzles 54 is provided and each of the nozzles 54 is strategically distributed around the range 12. Each of nozzles 54 is in fluid communication with the fire extinguisher 42 thereby facilitating each of the nozzles 54 to spray the fire retardant 44 when the fire extinguisher 42 is actuated. In this way the plurality of nozzles 54 can extinguish a fire that is burning in or on the range 12. The plurality of nozzles 54 includes an oven nozzle 56 and a set of burner nozzles 58. The oven nozzle 56 is positioned within the oven 14 and each of the burner nozzles 58 is positioned on the forward face 32 of the control panel 30 such that each of the burner nozzles 58 is directed toward a respective one of the burners 16. Each of the nozzles 54 may comprise a venturi nozzle or other type of nozzle that would be appropriate to discharge a pressurized fire retardant.

A plurality of conduits 60 is each integrated into the range 12. Each of the conduits 60 is in fluid communication with the valve 52 such that each of the conduits 60 receives the fire retardant 44 when the valve 52 is actuated into the open condition. Additionally, each of the conduits 60 is fluidly coupled to a respective one of the nozzles 54 for delivering the fire retardant 44 to the plurality of nozzles 54. A shut off 62 is integrated into the range 12 and the shut off 62 is in communication with a power source 63 supplying the range 12. The power source 63 may be a power cord or a gas line. The shut off 62 is electrically coupled to the control circuit 34 and the shut off 62 is actuated into an off position when the control circuit 34 receives the extinguish input. In this way the shut off 62 de-actuates each of the oven 14 and the burners 16. The shut off 62 may comprise a relay, a gas valve or any other mechanism that can be actuated to cut power to the range 12.

A door 64 is hingedly coupled to the front side 18 of the range 12 for opening and closing the oven 14, and the door 64 has a window 66 integrated therein. A display 68 is integrated into the window 66 of the door 64 and the display 68 is electrically coupled to the control circuit 34. The display 68 displays indicia 70 comprising an operational temperature of the oven 14. The display 68 may comprise a transparent LCD or other type of electronic display. A camera 72 is integrated into the oven 14 such that the camera 72 captures imagery of an interior of the oven 14 and the camera 72 is electrically coupled to the control circuit 34. The camera 72 may comprise a digital video camera or the like and the camera 72 may be housed in a heat resistant housing to protect the camera 72 from heat damage. A plurality of speakers 74 is each coupled to the forward face 32 of the control panel 30 and each of the speakers 74 emits an audible sound. Each of the speakers 74 is electrically coupled to the control panel 30 and the audible sound emitted by the speakers 74 may include, but not be limited to, audible alerts, pre-recorded messages and operational alerts.

A microphone 76 is integrated into the control panel 30 for receiving audible sounds and the microphone 76 is electrically coupled to the control circuit 34. The control circuit 34 may include an electronic memory 78 which stores operational software, including voice control software. The voice control software may include the functionality of a virtual assistant, such as Amazon Alexa, developed by Amazon Inc. 410 Terry Avenue North, Seattle, Wash. 98109, or other third party voice control software. The voice control software may facilitate a user to control all of the operational parameters of the range 12 with spoken commands. The control circuit 34 may include an electronic timer 80 that turns off each of the blowers 28 when the blowers 28 have been turned on for a pre-determined duration of time.

A first touch screen 82 is integrated into the control panel 30 and the first touch screen 82 is electrically coupled to the control circuit 34. The first touch screen 82 displays indicia 84 comprising temperature settings, timer durations and other operational parameters that are common to ranges and stoves. Additionally, the first touch screen 82 can be manipulated by a user to control the operational parameters of the range 12. A second touch screen 86 is integrated into the front side 18 of the range 12 and the second touch screen 86 is electrically coupled to the control circuit 34. The second touch screen 86 displays indicia 88 comprising temperature settings, timer durations and other operational parameters that are common to ranges and stoves. Additionally, the second touch screen 86 can be manipulated by a user to control the operational parameters of the range 12.

A transceiver 90 is integrated into the range 12 and the transceiver 90 is electrically coupled to the control circuit 34. The transceiver 90 is in wireless communication with a remote control 92, a personal electronic device 94, or both. As is most clearly shown in FIG. 6, the remote control 92 might include burner controls 96, oven controls 98 and other controls that are conventional to ranges and ovens. The personal electronic device 94 may comprise a smart phone or the like and the transceiver 90 may broadcast imagery from the camera 72 to the personal electronic device 94. In this way the user can remotely monitor the oven 14 while the oven 14 is cooking a food item. The transceiver 90 may comprise a radio frequency transceiver or the like and the transceiver 90 may employ Bluetooth communication protocols.

In use, the valve 52 is actuated into the open condition to release the fire retardant 44 from each of the nozzles 54 when the control circuit 34 receives the extinguish input. In this way an open flame that has developed in the oven 14 or on the burners 16 can be automatically extinguished. Additionally, the shut off 62 interrupts the power source 63 which supplies the range 12 with operational power. Moreover, the blowers 28 are turned on to ventilate the oven 14 and to facilitate the oven 14 to be cooled. In this way the fire is quickly extinguished and the range 12 is protected from heat damage that could result from the fire. Additionally, the user can remotely monitor the interior of the oven 14 with the personal electronic device 94 during normal operation to monitor cooking progress of a food item being cooked in the oven 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fire extinguishing range assembly for extinguishing a fire that develops from cooking food, said assembly comprising:

a range having an oven being integrated therein and a plurality of burners wherein said oven and each of said burners is configured to cook food items, wherein said range has a front side, a top wall, a first lateral wall and a second lateral wall, said front side being open into an interior of said range to define said oven, said range having a pair of vents each extending through a respective one of said first lateral wall and said second lateral wall into said oven wherein each of said vents is configured to pass air therethrough, each of said burners being positioned on said top wall, said range having a control panel extending upwardly from said top wall, said control panel having a forward face;

an oven temperature sensor being integrated into said range, said oven temperature sensor being positioned within said oven such that said oven temperature sensor is in thermal communication with an interior of said oven;

a burner temperature sensor being integrated into said range, said burner temperature sensor being positioned adjacent to said plurality of burners such that said burner temperature sensor is in thermal communication with said burners;

a fire extinguisher being integrated into said range, said lire extinguisher containing a fire retardant, said fire extinguisher being actuated when either of said burner temperature sensor or said oven temperature sensor senses a temperature that exceeds a pre-determined temperature; and a plurality of nozzles, said plurality of nozzles being strategically distributed around said range, each of said nozzles of said plurality of nozzles being in fluid communication with said fire extinguisher thereby facilitating each of said nozzles of said plurality of nozzles to spray the fire retardant when said fire extinguisher is actuated wherein said plurality of nozzles is configured to extinguish a fire that is burning in or on said range; and wherein said plurality of nozzles includes an oven nozzle and a set of burner nozzles, said oven nozzle being positioned within said oven, each of said burner nozzles being positioned on said forward face of said control panel such that each of said nozzles is directed toward a respective one of said burners.

2. The assembly according to claim 1, wherein:

said assembly includes a control circuit being integrated into said oven, said control circuit receiving an extinguish input, said control circuit being in communication with a heat source in said oven, said control circuit being in communication with each of said burners, said control circuit turning off said heat source in said oven and each of said burners when said control circuit receives said extinguish input;

said oven temperature sensor is electrically coupled to said control circuit, said control circuit receiving said extinguish input when said oven temperature sensor senses the temperature exceeds the pre-determined temperature; and said burner temperature sensor is electrically coupled to said control circuit, said control circuit receiving said extinguish input when said burner temperature sensor senses the temperature exceeds the pre-determined temperature.

3. The assembly according to claim 2, wherein:

said fire extinguisher has an outlet; and said assembly includes a valve being fluidly coupled to said fire extinguisher, said valve being in fluid communication with said outlet, said valve being actuatable into an open condition for releasing said fire retardant from said fire extinguisher, said valve being in a normally closed condition for inhibiting said fire retardant from escaping said fire extinguisher, said valve being electrically coupled to said control circuit, said valve being actuated into said open condition when said control circuit receives said extinguish input.

4. The assembly according to claim 3, further comprising a plurality of conduits, each of said conduits being integrated into said range, each of said conduits being in fluid communication with said valve such that each of said conduits receives said fire retardant when said valve is actuated into said open condition, each of said conduits being fluidly coupled to a respective one of said nozzles for delivering said fire retardant to said plurality of nozzles.

5. The assembly according to claim 2, further comprising a shut off being integrated into said range, said shut off being in communication with a power source supplying said range, said shut off being electrically coupled to said control circuit, said shut off being actuated into an off position when said control circuit receives said extinguish input such that said shut off de-actuates each of said oven and said burners.

6. A fire extinguishing range assembly for extinguishing a fire that develops from cooking food, said assembly comprising:

a range having an oven being integrated therein and a plurality of burners wherein said oven and each of said burners is configured to cook food items, said range having a front side, a top wall, a first lateral wall and a second lateral wall, said front side being open into an interior of said range to define said oven, said range having a pair of vents each extending through a respective one of said first lateral wall and said second lateral wall into said oven wherein each of said vents is configured to pass air therethrough, each of said burners being positioned on said top wall, said range having a control panel extending upwardly from said top wall, said control panel having a forward face;

a control circuit being integrated into said oven, said control circuit receiving an extinguish input, said control circuit being in communication with a heat source in said oven, said control circuit being in communication with each of said burners, said control circuit turning off said heat source in said oven and each of said burners when said control circuit receives said extinguish input;

an oven temperature sensor being integrated into said range, said oven temperature sensor being positioned within said oven such that said oven temperature sensor is in thermal communication with an interior of said oven, said oven temperature sensor being electrically coupled to said control circuit, said control circuit receiving said extinguish input when said oven temperature sensor senses a temperature that exceeds a pre-determined temperature;

a burner temperature sensor being integrated into said range, said burner temperature sensor being positioned adjacent to said plurality of burners such that said burner temperature sensor is in thermal communication with said burners, said burner temperature sensor being electrically coupled to said control circuit, said control circuit receiving said extinguish input when said burner temperature sensor senses a temperature that exceeds a pre-determined temperature;

a fire extinguisher being integrated into said range, said fire extinguisher containing a fire retardant, said tire extinguisher having an outlet;

a valve being fluidly coupled to said fire extinguisher, said valve being in fluid communication with said outlet, said valve being actuatable into an open condition tor releasing said fire retardant from said fire extinguisher, said valve being in a normally closed condition for inhibiting said fire retardant from escaping said fire extinguisher, said valve being electrically coupled to said control circuit, said valve being actuated into said open condition when said control circuit receives said extinguish input;

a plurality of nozzles, said plurality of nozzles being strategically distributed around said range, each of said nozzles of said plurality of nozzles being in fluid communication with said fire extinguisher thereby facilitating each of said nozzles of said plurality of nozzles to spray the fire retardant when said lire extinguisher is actuated wherein said plurality of nozzles is configured to extinguish a fire that is burning in or on said range, said plurality of nozzles including an oven nozzle and a set of burner nozzles, said oven nozzle being positioned within said oven, each of said burner nozzles being positioned on said forward face of said control panel such that each of said nozzles is directed toward a respective one of said burners;

a plurality of conduits, each of said conduits being integrated into said range, each of said conduits being in fluid communication with said valve such that each of said conduits receives said fire retardant when said valve is actuated into said open condition, each of said conduits being fluidly coupled to a respective one of said nozzles for delivering said fire retardant to said plurality of nozzles; and a shut off being integrated into said range, said shut off being in communication with a power source supplying said range, said shut off being electrically coupled to said control circuit, said shut off being actuated into an off position when said control circuit receives said extinguish input such that said shut off de-actuates each of said oven and said burners.

* * * * *